US008196529B2

(12) United States Patent
Witkowski

(10) Patent No.: US 8,196,529 B2
(45) Date of Patent: Jun. 12, 2012

(54) FOLDABLE TABLE

(76) Inventor: Andrej Witkowski, Hagersten (SE)

( * ) Notice: Subject to any disclaimer, the term of this patent is extended or adjusted under 35 U.S.C. 154(b) by 191 days.

(21) Appl. No.: 12/616,632

(22) Filed: Nov. 11, 2009

(65) Prior Publication Data

US 2010/0116176 A1 May 13, 2010

(30) Foreign Application Priority Data

Nov. 11, 2008 (SE) ..... 0850072

(51) Int. Cl.
*A47B 3/00* (2006.01)

(52) U.S. Cl. ..... 108/115; 108/173; 108/50.12

(58) Field of Classification Search ..... 108/115, 108/79, 170, 167, 173, 175, 50.12, 50.11; 135/16

See application file for complete search history.

(56) References Cited

U.S. PATENT DOCUMENTS

| | | | | | |
|---|---|---|---|---|---|
| 586,112 | A | * | 7/1897 | Beloin | 108/167 |
| 1,828,780 | A | * | 10/1931 | McKnight | 108/173 |
| 2,764,460 | A | | 9/1956 | Nelson | |
| 2,781,525 | A | | 2/1957 | Bauer | |
| 2,782,085 | A | | 2/1957 | Natale | |
| 2,913,294 | A | * | 11/1959 | Linde | 108/167 |
| 3,006,705 | A | * | 10/1961 | Williams et al. | 108/50.12 |
| 3,101,062 | A | * | 8/1963 | Kanzelberger | 108/173 |
| 3,351,029 | A | * | 11/1967 | Bue | 108/170 |
| 3,476,061 | A | | 11/1969 | Takahashi | |
| 3,511,532 | A | * | 5/1970 | Tringali et al. | 108/173 |
| 4,646,657 | A | * | 3/1987 | Zollinger | 108/173 |
| 4,740,010 | A | * | 4/1988 | Moskovitz | 108/170 |
| 5,215,108 | A | * | 6/1993 | Sprague | 108/50.12 |
| 6,866,054 | B1 | * | 3/2005 | Collins | 108/50.12 |
| 7,101,000 | B2 | * | 9/2006 | DeMars | 108/50.12 |
| 2010/0301641 | A1 | * | 12/2010 | Rivera et al. | 108/115 |

FOREIGN PATENT DOCUMENTS

| | | |
|---|---|---|
| GB | 286458 | 3/1928 |

* cited by examiner

*Primary Examiner* — Jose V Chen
(74) *Attorney, Agent, or Firm* — Holland & Hart LLP

(57) ABSTRACT

Foldable table that is easy to handle is described, which is provided for use by a plurality of people but do not require a plurality of people when it is folded. The table can be unfolded and be folded in a fast and simple way, and can be provided with a parasol, wherein the table and the parasol can be unfolded simultaneously. The foldable table comprises a first and a second table-top section (2*a, b*), two leg supports (4*a*, 4*b*) and a-guide rod (3), the at least two leg supports (4*a*, 4*b*) are arranged on opposing sides of the guiding rod (3) and each of the first and the second table-top sections—(2*a*, 2*b*) extends between the guiding rod (3) and a respective one of the leg supports (4*a*, 4*b*), so that the table can take a folded as well as an unfolded position wherein the table rests on the leg supports with the guide rod lifted vertically upwards in relation to the leg supports and with the table-top sections extending vertically between the guiding rod and the respective one of the leg supports, and an unfolded position wherein the table rests on the leg supports (4*a*, 4*b*) and have the table-top sections extending horizontally between the guiding rod and the respective one of the leg supports.

6 Claims, 6 Drawing Sheets

FOLDABLE TABLE

TECHNICAL FIELD

The invention relates to foldable tables and also to foldable tables with parasols.

BACKGROUND

Foldable tables have been designed, for example, to casually create extra table-top surfaces during larger events and to be able to more easily stow away the table when it is no longer needed. Others have been designed for the purpose of more easily being transported. Folding the tables means that a new task has emerged when handling a table, a task that can be especially troublesome when large tables are handled by few people or only one person.

Foldable parasols and unbrellas are also previously known. They require a certain handling as well, especially if they have a large size. Larger parasols can be designed as a so called double parasol, comprising two parasol poles that carry a common oval cloth for protection against the sun. Such an oval parasol has been suitable especially for oblong, rectangular or oval tables having space for several people. A problem is that the handling of the parasol creates difficulties that grows when the size grows.

SUMMARY OF THE INVENTION

An aim of the invention is to create a foldable table that is easy to handle. An aim is to create a table for use by a plurality of people but do not require a plurality of people, to be folded. Another aim is to create a table that can be unfolded and folded in a fast and easy way. A further aim is to create a foldable table having a parasol, where the table and the parasol can be unfolded simultaneously.

The invention provides for these purposes a foldable table, comprising a first and a second table-top sections, at least two leg supports and a guiding rod centrally arranged between the leg supports, the at least two leg supports are arranged on opposite sides of the guiding rod and each one of the first and second table-top sections extends between the guiding rod and a respective one of the leg supports, each table-top section being rotatably attached to the guiding rod and its respective one of the leg-supports. The table is designed so that it can be in a folded position where the table rests on the leg supports with the guiding rod vertically raised in relation to the leg supports and with the table-top sections extending vertically between the guiding rod and each respective leg support, and an unfolded position where the table rests on the leg supports having the table-top sections horizontally extended between the guiding rod and each respective leg support. The folded storing position utilises the height for storing the table-top sections so the handling can mainly be carried out by raising the guiding rod between the leg supports.

Preferably, the two leg supports and the guiding rod have substantially the same height, and, in the unfolded position, the table rests on the leg supports and the guiding rod.

It is preferred that the table rests on the guiding rod in the unfolded position, but an alternative is that the guiding rod is fastened against movement in another way in the unfolded position of the table, for example by means of a locking mechanism described in greater detail below.

Preferably, the table is also provided with a first and a second supporting arm, each one of the supporting arms being arranged between the lower part of a respective leg support and the lower part of the central guiding rod, rotatably attached at each respective leg support and at the guiding rod. The leg supports are supported by these arms so that they are kept parallel more easily, parallel to the guiding rod, and these arms also contribute to further a facilitated handling.

Preferably, the table is also provided with two guide struts arranged symmetrically, each one extending between the guiding rod and a respective one of the table-top sections, the guiding struts being vertically slidable and rotatably attached to the guiding rod and rotatably attached to the respective table-top section. Hereby the vertical orientation of the leg supports is maintained during handling of the table. These guide struts can preferably be fixed by a locking mechanism that prevents the vertical movement of the guiding rod, so that the table and the guiding rod can be locked in the position of use. Other parts of the table can also be adapted for mutual interlocking, as a complement or as an alternative to the locking of the guide struts to the guiding rod.

The foldable table is preferably also provided with upper horizontal plates in each one of the leg supports, which horizontal plates create a table top together with the table-top sections in the unfolded position of the table. In contrast to the table-top sections, the horizontal plates are always horizontal, also in the folded storage position. Each of these upper horizontal plates preferably comprises a support for, for example, a parasol pole. Since they are attached to the leg supports and move horizontally without rotation during handling of the table, one and the same parasol can stand upright in the plate in the folded as well as in the unfolded position and during the handling between these, positions. Moreover the horizontal movement of the leg supports and thereby also the movement of parasol poles can be used for opening, for example, a double parasol. This can, e.g., be provided by connecting a wire or rope between the opening mechanisms in the two halves of the double parasol, so that this wire or rope is tensioned and opens the halves of the parasol when the parasol poles and the leg supports are moved simultaneously horizontally away from each other when the table is unfolded.

The invention also provides an arrangement of a foldable table and a double parasol, where the table and the double parasol can be unfolded simultaneously. This is achieved by attaching the double parasol to leg supports of the table, which leg supports and thereby also the parasol poles, move in relation to each other when the table is put in place and by means of the interconnection of the opening mechanisms of the double parasol and use the relative movement for maneuvering the opening mechanisms.

Preferably, the double parasol comprises two poles, each one of which is attached to a respective one of the leg supports.

SHORT DESCRIPTION OF THE DRAWINGS

DETAILED DESCRIPTION OF EMBODIMENTS

Figure 1:
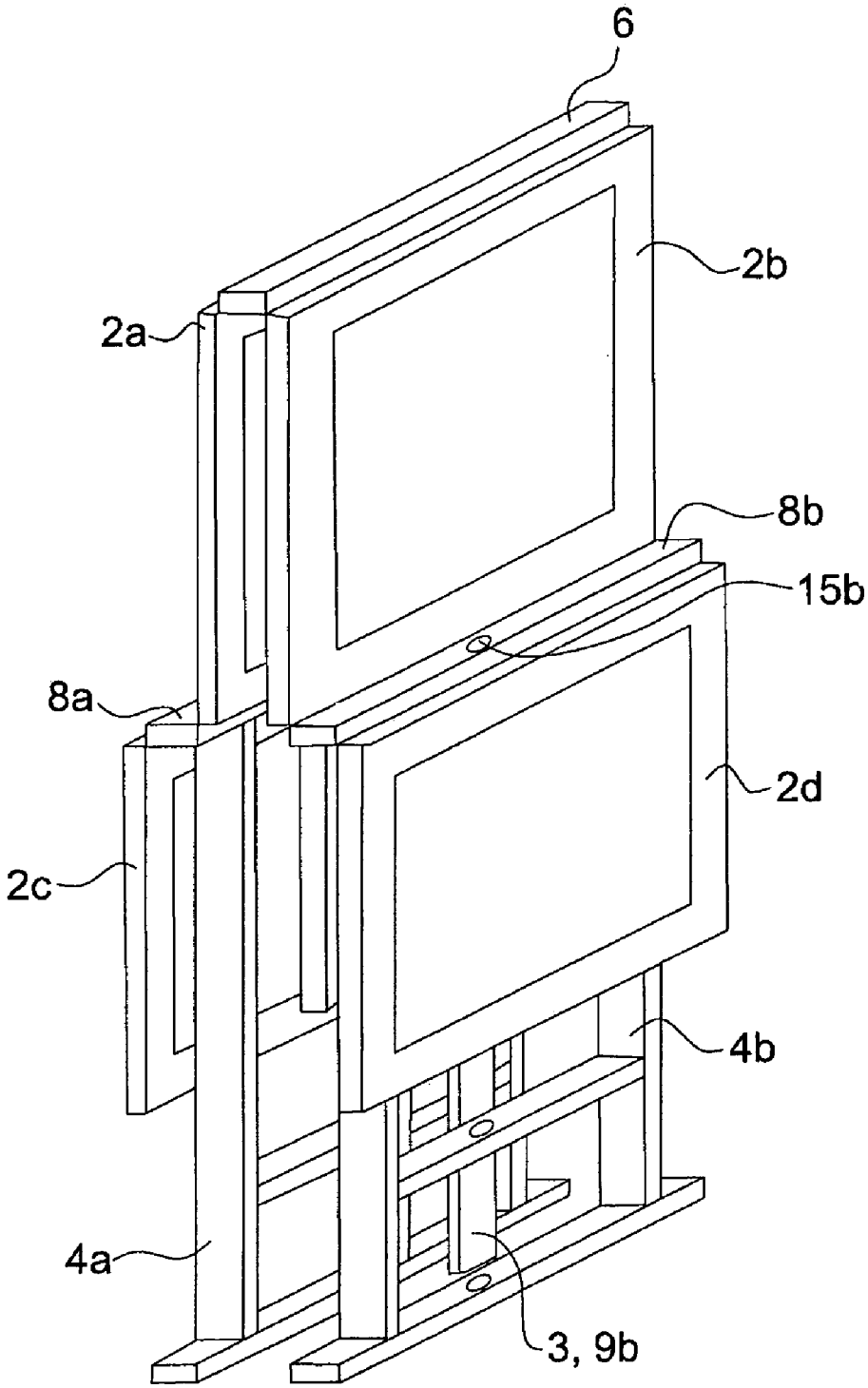
FIG. 1 illustrates a foldable table in accordance with the invention in a side view in a folded position.
Figure 2:
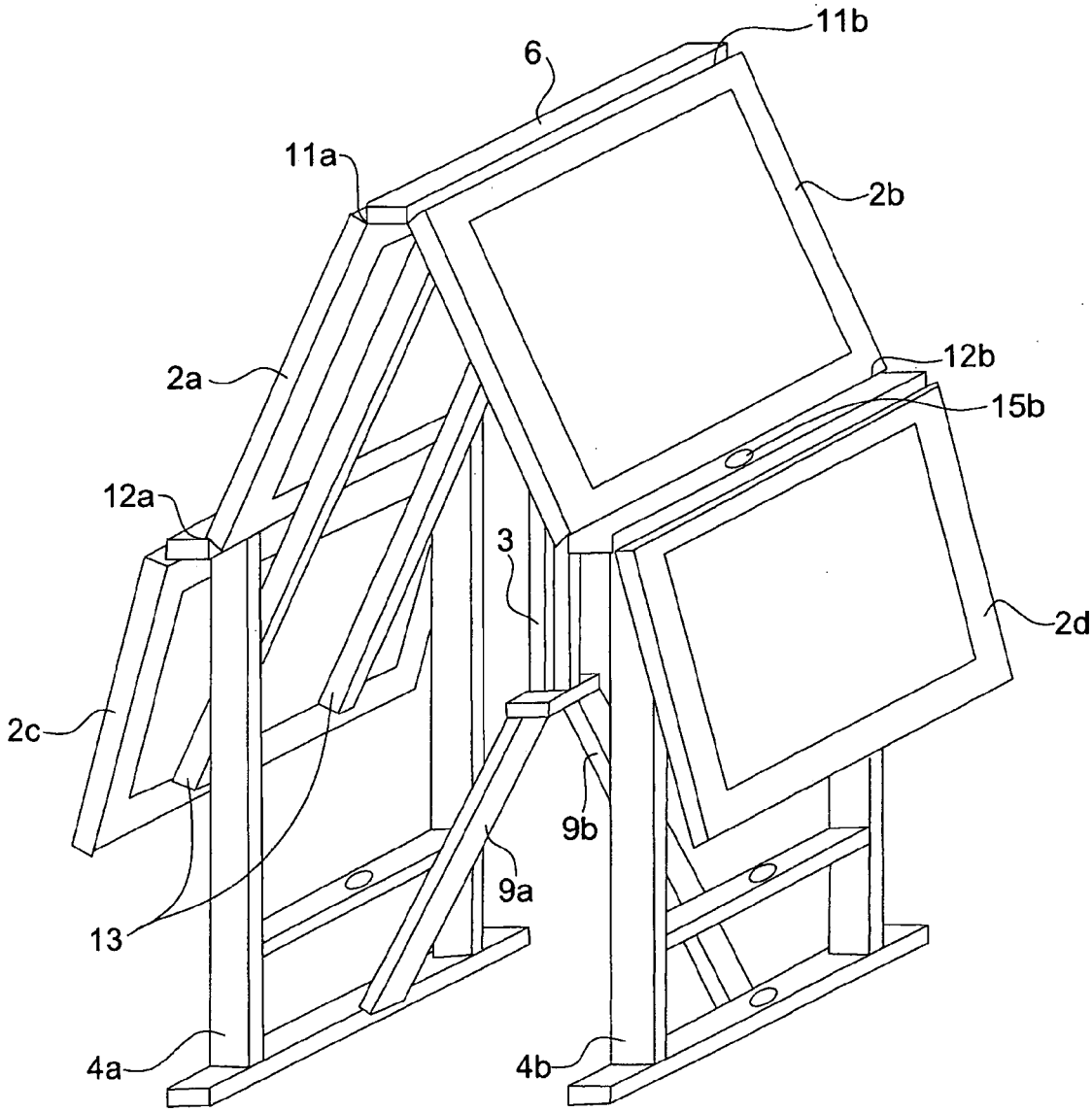
FIG. 2 illustrates the table of FIG. 1 being unfolded.
Figure 3:
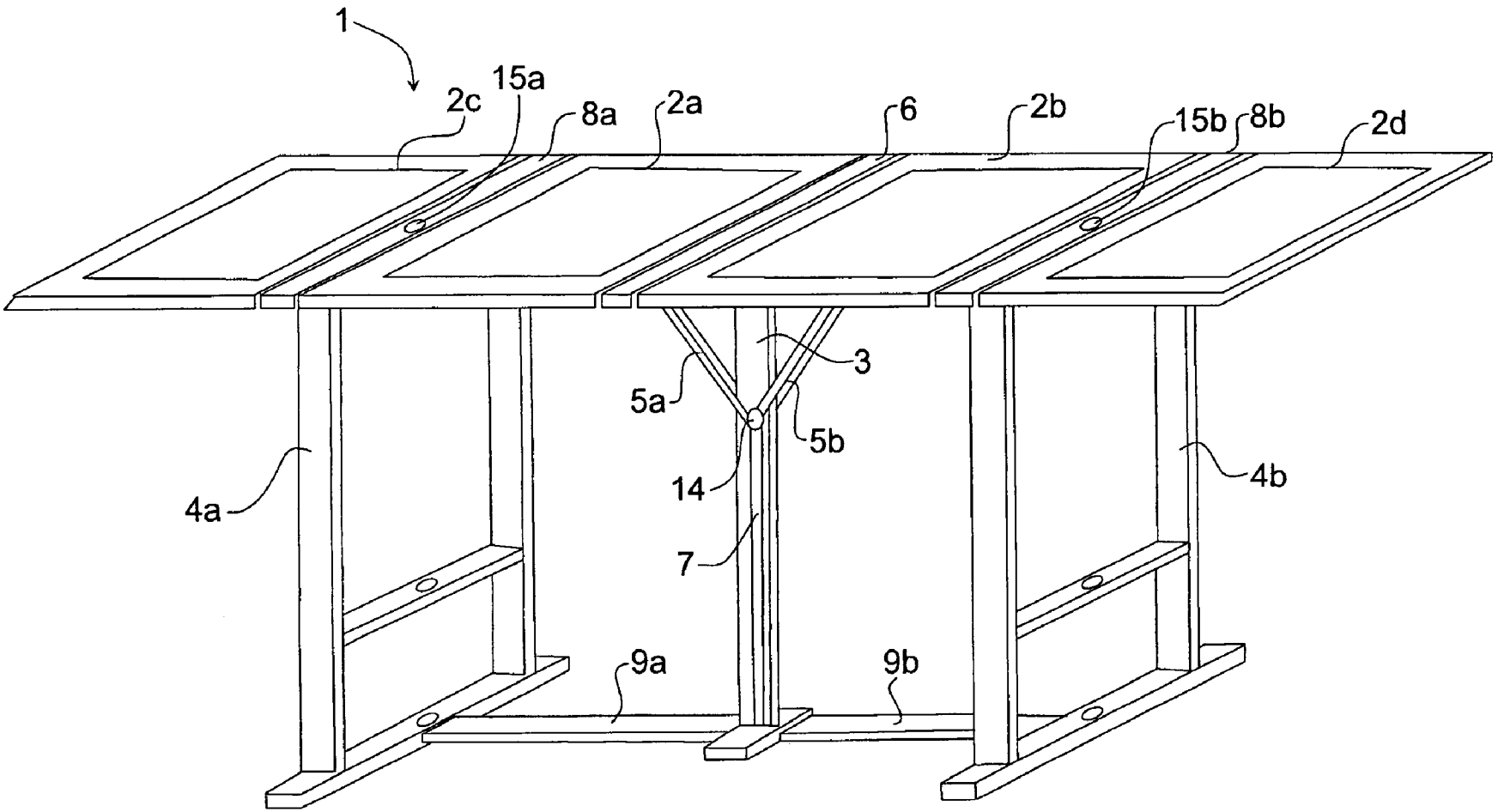
FIG. 3 illustrates the table unfolded for use.

FIG. 1-3 illustrates an example of a foldable table 1 in accordance with the invention. The table is illustrated in the folded position in FIG. 1. FIG. 2 illustrates the same table as is illustrated in FIG. 1, wherein FIG. 2 the table is illustrated in an intermediate position when handling the table; between folded and unfolded positions, and FIG. 3 shows the table in the unfolded position. The table is rectangular and its parts are essentially symmetrically arranged in its two halves.

The table comprises four table-top sections 2*a-d*, which essentially form a rectangular surface in the unfolded position, two leg supports or stands 4*a*, 4*b* and a guiding rod 3 centrally arranged between the leg supports 4*a*, 4*b* and below the table-top sections 2*a-d*. Each leg support 4*a*, 4*b* comprises two legs having lateral beams in-between. The guiding rod 3 and the leg supports 4*a*, 4*b* are provided with a respective upper plate 6, 8*a*, 8*b*, which upper plates, together with the table-top sections 2*a-d*, form the surface of the table in the unfolded position. In the unfolded position the table rests on the leg supports 4*a*, 4*b* and suitably also on the guide rod 3, which are mutually parallel and vertically arranged. The inner edges of the table-top sections 2*a-d*, towards the guiding rod 3, are rotatably fixed through joints 11*a-b* to the guiding rod. The outer edges of the table-top sections 2*a-d*, towards the inner leg supports 4*a-b*, are rotatably attached to the leg, supports through joints 12*a, b*. The table-top sections are vertically arranged, in the folded position of the table, and horizontally arranged in the unfolded position of the table. The leg supports 4*a*, 4*b* are vertically arranged in both the folded as well as in the unfolded position. The centrally arranged guiding rod 3 is vertically arranged in both the folded as well as in the unfolded position. The upper plates 6, 8*a-b* are horizontally arranged in both the folded as well as, in the unfolded position. The table is folded by lifting the centrally arranged guiding rod 3. When the table is maneuvered from the unfolded to the folded position, the table-top sections 2*a, b* are rotated, and the inner edges follow the guiding rod 3 in its movement upwards. The sideways arranged leg supports are carried horizontally inwards during the folding motion together with the outer edges of the table-top sections.

The lower portion of the guiding rod is provided with support arms 9*a*, 9*b* that are parallel to the table-top portions 2*a-d* and rotatably attached in their endings in the guiding rod 3 and to the leg supports 4*a*, 4*b*, one support arm 9*a-b* between each leg support 4*a-b* and the guiding rod 3. These support arms 9*a-b* holds the leg supports mutually parallel. For facilitating maintaining the led supports 4*a-b* vertical during maneuvering the table, the guiding rod is provided with two guide struts 5*a*, 5*b* rotatably arranged and having their inner ends in a slidable hold, in a slit or slide track 7. The outer ends of the guide struts are fixed by joints to a respective table-top section 2*a-b*.

The table is also provided with outer table-top sections 2*c*, 2*d* that are rotatably, attached by joint to the leg supports. The outer table-top sections 2*c*, 2*d* are arranged outside the leg supports. In FIG. 2, support arms 13*a*, 13*b* are illustrated for the outer table-top sections, that are attached below, attached to and fellows the movements of the inner table-top sections 2*a*, 2*b*. The support arms extend from the inner table-top sections 2*a*, 2*b* outwardly below and inside the outer sections 2*c-d* in the unfolded and folded position, respectively. When the inner table-top sections are vertical, the support arms are directed down, when the inner table-top sections are horizontal, the support arms 13*a-b* are directed horizontally outwards and carry the outer table-top sections the horizontal direction. The outer sections 2*c-d* are illustrated in the figure as being rectangular, but can alternatively be designed in other ways and be of a semi-circular or oval shape.

In the folded position, the storing position that is illustrated in FIG. 1, the leg supports rest on the ground, such as a floor, oriented in a vertical direction and carries the table. In this position the guiding rod 3 is raised from the floor and extends vertically. The table-top sections 2*a-d* are also vertical, the inner 2*a-b* as well as the outer 2*c-d* table-top sections. The guiding rod 3 is raised a distance corresponding to the width of the inner table-top sections 2*a-b* from the guiding rod to the leg supports. The outer table-top sections can be longer than illustrated in the figure and extend from the stands 4*a*, 4*b* down to the floor. The inner table-top sections can also be longer than illustrated, for example longer than the outer table-top sections. The leg supports are positioned inserted in the horizontal direction towards the guide rod, their upper plates 8*a*, 8*b*, which plates are a part of the surface of the table when the table is unfolded, are directed horizontally differing from the vertically oriented table-top sections. The upper plates 8*a-b* in the leg supports 4*a-b* are provided with holds in the form of holes 15*a-b*. The upper plates 8*a-b* do not rotate when the table is unfolded and their holds move only horizontally outwardly.

When the table is unfolded, as in FIG. 2, which also illustrates when the table is folded in, in a position between the folded and unfolded position, the leg supports have moved horizontally outwards from the guide rod and the guiding rod has moved vertically downwards. The table-top sections 2*a-d* have been rotated to an angled position, between vertical and horizontal. The inner edges of the inner table-top sections 2*a-b* have followed the guide rod vertically downwards and the outer edges of the inner table-top sections have followed the leg supports horizontally outwards. The outer table-top portions, which are attached to the leg supports 2*a-b* by means of a joint 12*c-d* follow the leg supports 2*a-b* horizontally outwards and are angled up by being lifted by the support arms 13*a-b* that are attached to the inner table-top sections 2*a-b*.

The upper plates 8*a-b* are horizontal during the motion and follow the leg supports 2*a-b* horizontally outwards and remain in the same height during the movement. The direction and height of the holds, illustrated by the vertical holes 15*a-b*, in the upper plates remain the same. The upper plate 6 in the central guiding rod 3 moves downwards and is oriented horizontally all the time.

The lower support arms 9*a*, 9*b* hold the leg supports 4*a-b* parallel during the movement and the guide struts 5*a*, 5*b* move vertically in a slit 7, which form a slide path, and have an upraising effect on the leg supports.

In the unfolded position, the use position in accordance with FIG. 3, the table-top sections are horizontal and form together with the horizontal upper plates 6, 8*a-b* a table surface. In the unfolded position, the table rests on the guiding rod 3 as well as on the leg supports 4*a*, 4*b*, which are of the same length and rest on the floor.

Figure 4:
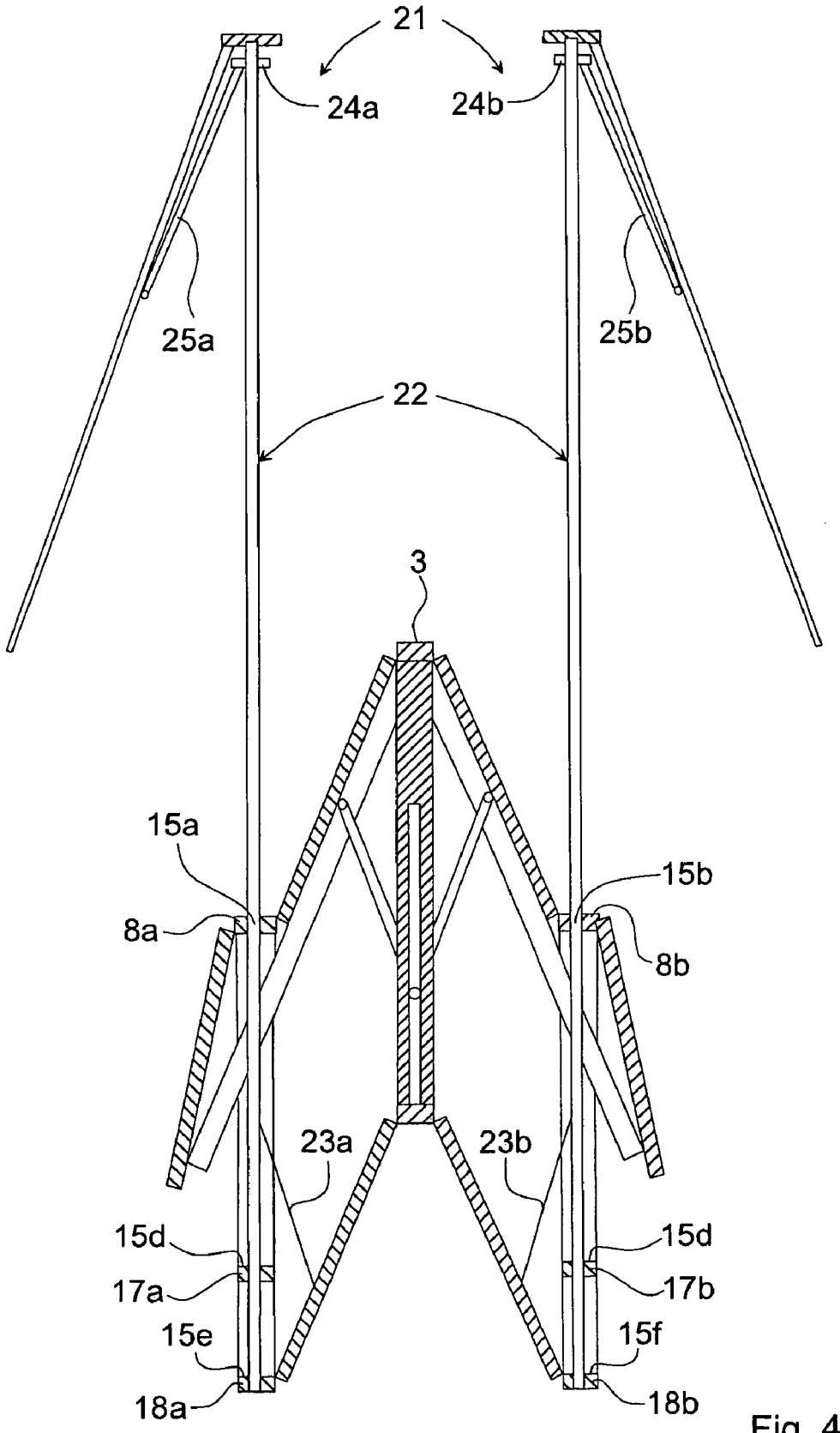
FIG. 4 illustrates the table provided with a double parasol.
Figure 5:
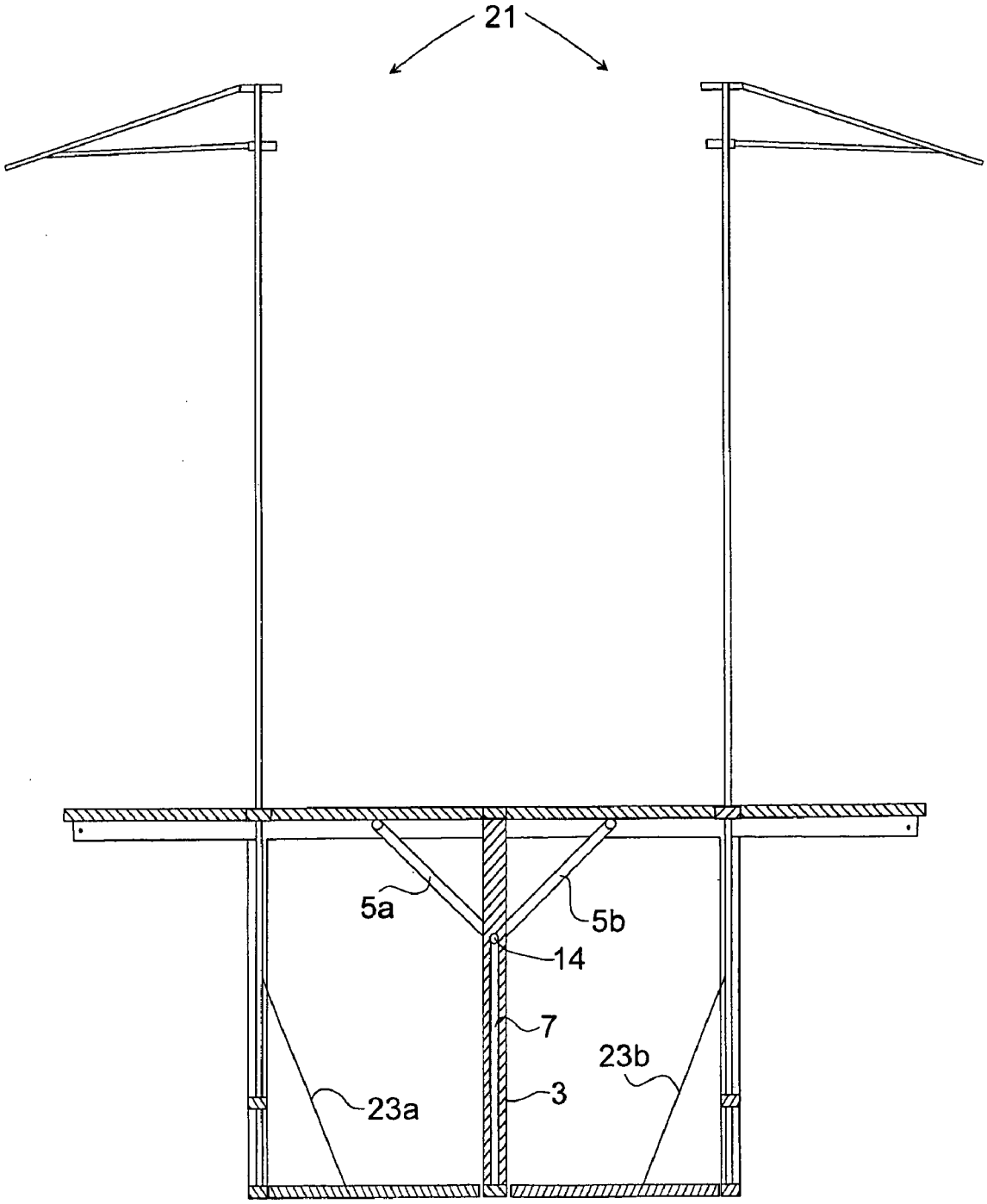
FIG. 5 illustrates the table and the double parasol unfolded.

FIGS. 4 and 5 shows a table 1 in accordance with the invention, in a side view and cross section, provided with a double parasol 21. The double parasol 21 comprises two poles that are attached to the table, by means of standing in the holes 15*a, b* in the upper plates 8*a*, 8*b* in the leg supports and they also stand in the lower parts of the leg supports 4*a*, 4*b* in holes 15*c-f*, arranged in lateral struts or beams 17*a*, 17*b* in the leg supports and in lateral foot plates 18*a*, 19*b* in the leg supports.

When the table is unfolded, both poles 22*a-b* of the double parasol 21 follows with the horizontal movement of the leg supports outwardly. The double parasol comprises an opening mechanism 24*a-b* in each half of the parasol. The illustrated mechanism comprises a downwardly directed opening struts 25*a-b* and opens the parasol by being brought downwards. An alternative is to use a double parasol having upwardly directed opening struts, which opens the parasol when they are brought upwards. To open the double parasol, the double parasol is provided with two wires 23*a*, 23*b* that runs inside the poles 22*a-b* (one in each) to a respective one of the opening mechanisms 24*a-b*. These wires 23*a-b* are coupled to a part that moves in relation to the leg supports during the unfolding of the table, for example the guide pole 3, the opposite leg support, opposite wire, the opening mechanism of the other half of the parasol or, as is illustrated in FIG. 4 and in FIG. 5, to a respective support arm 9*a-b*. The extension and length of the wire is adapted so that the mutual movement will pull the wire so that it unfolds the double parasol completely when the table reaches its fully unfolded position (FIG. 5) having horizontal table-top sections. In this position the table can, and with the table the double parasol, be secured by means of the locking mechanism 14 of guide struts 5*a*, 5*b* in the slit 7 in the guiding rod 3. In the case with parasols having opening struts that are brought upwards along the parasol pole, the wire is suitably lead to a wheel on an axle in the top of the parasol pole and downwards to the opening strut, so that this is pulled upwards by the wire when it is pulled and tensioned. Also as an alternative to being lead inside the pole, the wire can be arranged on the outside of the pole.

Figure 6:
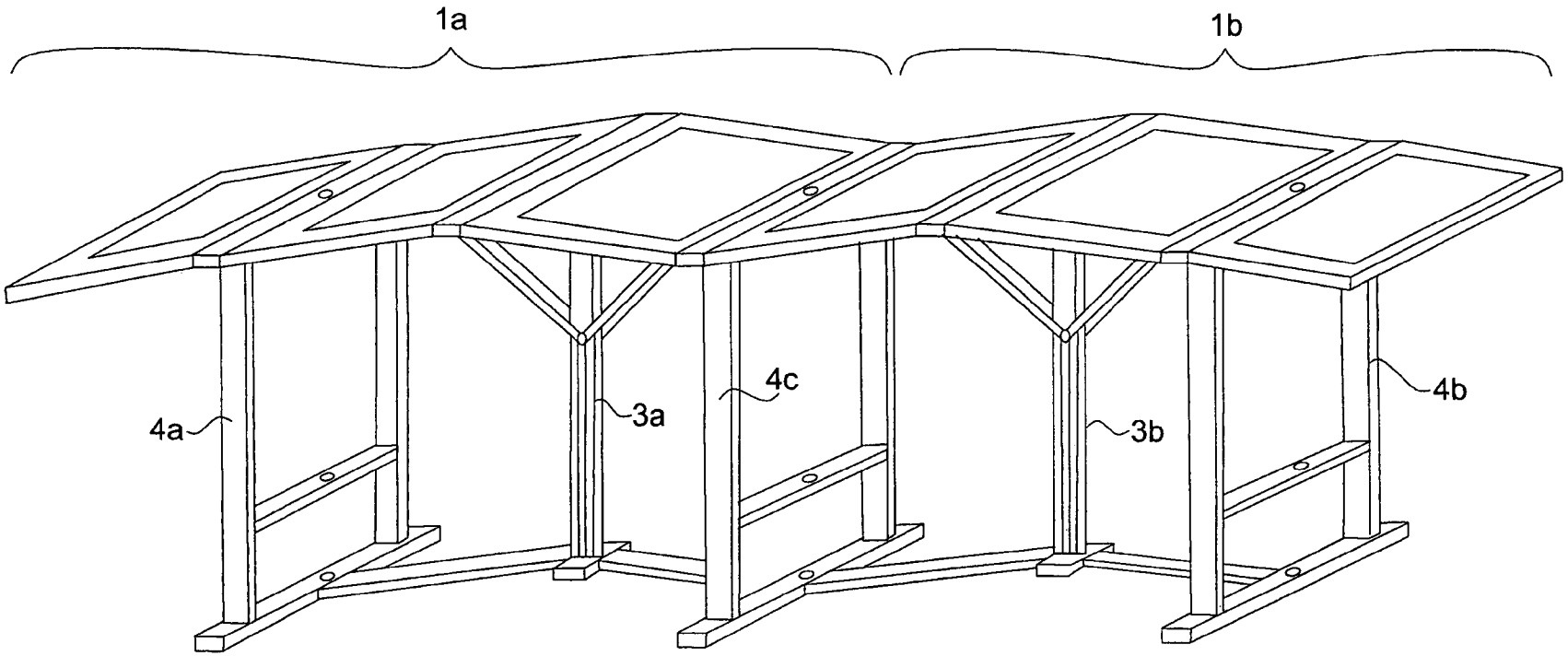
FIG. 6 illustrates a larger embodiment of the table in accordance with the invention.

FIG. 6 illustrates a foldable table according to the invention, which comprises three leg supports 4*a-c* and to support rods 3*a-b*. The table in FIG. 6 comprises two tables 1*a-b*, each having two table-top sections 2*a-d* between two leg supports 4*a-c* and a guide rod arranged centrally between the leg supports, in the same way as the table in FIG. 1-3. The two tables 1*a-b* have one of their two respective leg supports in common, the inner leg support 4*c*. The two tables also have an outer table-top section each, outside of its respective outer table-top section 4*a-b*. Thus, this table includes three leg supports in a row with two support rods arranged between the three leg supports, and also has six table-top portions. The table is folded, by lifting the supports 3*a-b* vertically upwards in relation to the leg supports in the same way as the simpler table of FIG. 1. Thereby the table-top surface is larger; the storing height corresponds to the storing height for the simpler table, while the table in the folded position is wider than the simpler table. Similarly, even longer tables can be designed having leg supports and support rods alternating, wherein the leg supports are moved horizontally and the support rods are lifted vertically when the table is folded.

The invention claimed is:

1. Foldable table comprising a first and a second table-top sections, at least two leg supports and a guiding rod, the at least two leg supports are is arranged on opposite sides of the guiding rod and each one of the first and second table-top sections extends between the guiding rod and a respective one of the leg supports, each table-top section being rotatably attached to the guiding rod and its respective one of the leg supports, so that the table can be in a folded position where the table rests on the leg supports with the guiding rod vertically raised in relation to the leg supports and with the table-top sections extending vertically between the guiding rod and each respective leg support, and an unfolded position where the table rests on the leg supports and with the table-top sections horizontally extended between the guiding rod and each respective leg support, wherein each one of the leg supports comprises an upper horizontal plate that remains horizontal during movement from the folded position to the unfolded position, which creates a table top together with the table-top sections in the unfolded position of the table, and each upper horizontal plate comprises a socket for a parasol pole.

2. Foldable table according to claim 1, wherein each of the two leg supports and the guiding rod have substantially the same height, and the table in the unfolded position, rests on the leg supports and the guiding rod.

3. Foldable table according to claim 1, provided with a first and a second supporting arm, each of the supporting arms being arranged between the lower part of a respective leg support and the lower part of the central guiding rod, rotatably attached at each-respective leg support and the guiding rod.

4. Foldable table according to claims 1, comprising a first and a second guide strut extending between the guiding rod and a respective one of the table-top sections vertically slidable and rotatably attached to the guiding rod and rotatably attached to the respective table-top section.

5. Foldable table according to claim 4 comprising at least one locking mechanism for locking the vertical movements of the guide struts at the guide rod.

6. Foldable table construction comprising two foldable tables according to claim 1, which two foldable tables share one of their leg supports.

* * * * *